US006246189B1

(12) United States Patent
Lee

(10) Patent No.: US 6,246,189 B1
(45) Date of Patent: Jun. 12, 2001

(54) DISPLAY DEVICE FOR CORRECTING A DISTORTION OF A BOTTOM PORTION OF A MONITOR

(75) Inventor: Seung-Taek Lee, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/365,504

(22) Filed: Aug. 2, 1999

(30) Foreign Application Priority Data

Jul. 31, 1998 (KR) ..... 98-31317

(51) Int. Cl.[7] ..... G09G 1/04
(52) U.S. Cl. ..... 315/370; 315/364; 348/806
(58) Field of Search ..... 315/364, 370, 315/379, 384, 369, 371; 348/806

(56) References Cited

U.S. PATENT DOCUMENTS 5,021,719 * 6/1991 Arai et al. ..... 315/364
5,898,467 * 4/1999 Woo ..... 348/806
6,020,694 * 2/2000 Shim ..... 315/387
6,060,845 * 5/2000 Tsukahara et al. ..... 315/370
6,108,045 * 8/2000 Onozawa et al. ..... 348/556
6,124,685 * 9/2000 Toriu et al. ..... 315/370

* cited by examiner

*Primary Examiner*—Don Wong
*Assistant Examiner*—Hoang Nguyen
(74) *Attorney, Agent, or Firm*—Staas & Halsey LLP

(57) ABSTRACT

A display device for correcting a distortion of a bottom portion of a monitor, including a vertical output circuit to generate a vertical output signal; a vertical signal detecting part which detects the vertical output signal and ensures that the vertical output signal has a necessary voltage; a vertical blanking signal generating part which converts the vertical output signal detected from the vertical signal detecting part to a vertical blanking signal; a phase controlling part which varies a phase of the vertical blanking signal; and an integral circuit which integrates the phase varied vertical blanking signal received from the phase controlling part and piling up it on a horizontal size controlling circuit. The display device produces the vertical blanking signal and controls and integrates the phase thereof through monostable multivibrator and piles up it on a horizontal size controlling circuit, so as to correct a distortion of a bottom portion of a monitor.

15 Claims, 1 Drawing Sheet

DISPLAY DEVICE FOR CORRECTING A DISTORTION OF A BOTTOM PORTION OF A MONITOR

CROSS-REFERENCE TO RELATED APPLICATIONS

This application claims the benefit of Korean Application No. 98-31317, filed Jul. 31, 1998, in the Korean Patent Office, the disclosure of which is incorporated herein by reference.

BACKGROUND OF THE INVENTION

1. Field of the Invention

The present invention relates to a display device, and more particularly, to a display device for correcting a distortion occurring in a bottom portion of a monitor.

2. Description of the Related Art

A display monitor is provided with an electronic gun emitting an electronic beam which is scanned to a monitor in horizontal deflection, and a picture is formed according to a density of the electronic beam. The electronic beam is deflected by an electromagnetic field formed from a deflection yoke. Therefore, when the electromagnetic field is affected by any cause from the outside, the deflection angle of the electronic beam can be distorted.

One of these distortions is that a picture is formed horizontally or vertically asymmetrical as a scanning of the electronic beam is performed abnormally by a resistance value of a picture receiving tube, except by a picture rotation due to an outside electromagnetic field. In addition, a picture may not rectangularly be displayed when an electric current is excessively provided to a deflection yoke.

SUMMARY OF THE INVENTION

Accordingly, in order to overcome such drawbacks in the conventional art, it is therefore an object of the present invention to provide a display device for correcting a distortion occurring in a bottom portion of a monitor.

Additional objects and advantages of the invention will be set forth in part in the description which follows and, in part, will be obvious from the description, or may be learned by practice of the invention.

To achieve the above and other objects and advantages and in accordance with the purpose of the present invention, as embodied and broadly described, there is provided a display device for correcting a distortion of a bottom portion of a monitor, and having a vertical output circuit to generate a vertical output signal, the display device comprising: a vertical signal detecting part which detects the vertical output signal and ensures that the vertical output signal has a necessary voltage; a vertical blanking signal generating part which converts the vertical output signal detected from the vertical signal detecting part to a vertical blanking signal; a phase controlling part which varies a phase of the vertical blanking signal; and an integral circuit which integrates the phase varied vertical blanking signal and piling up it on a horizontal size controlling circuit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DESCRIPTION OF THE PREFERRED EMBODIMENT

Figure 1:
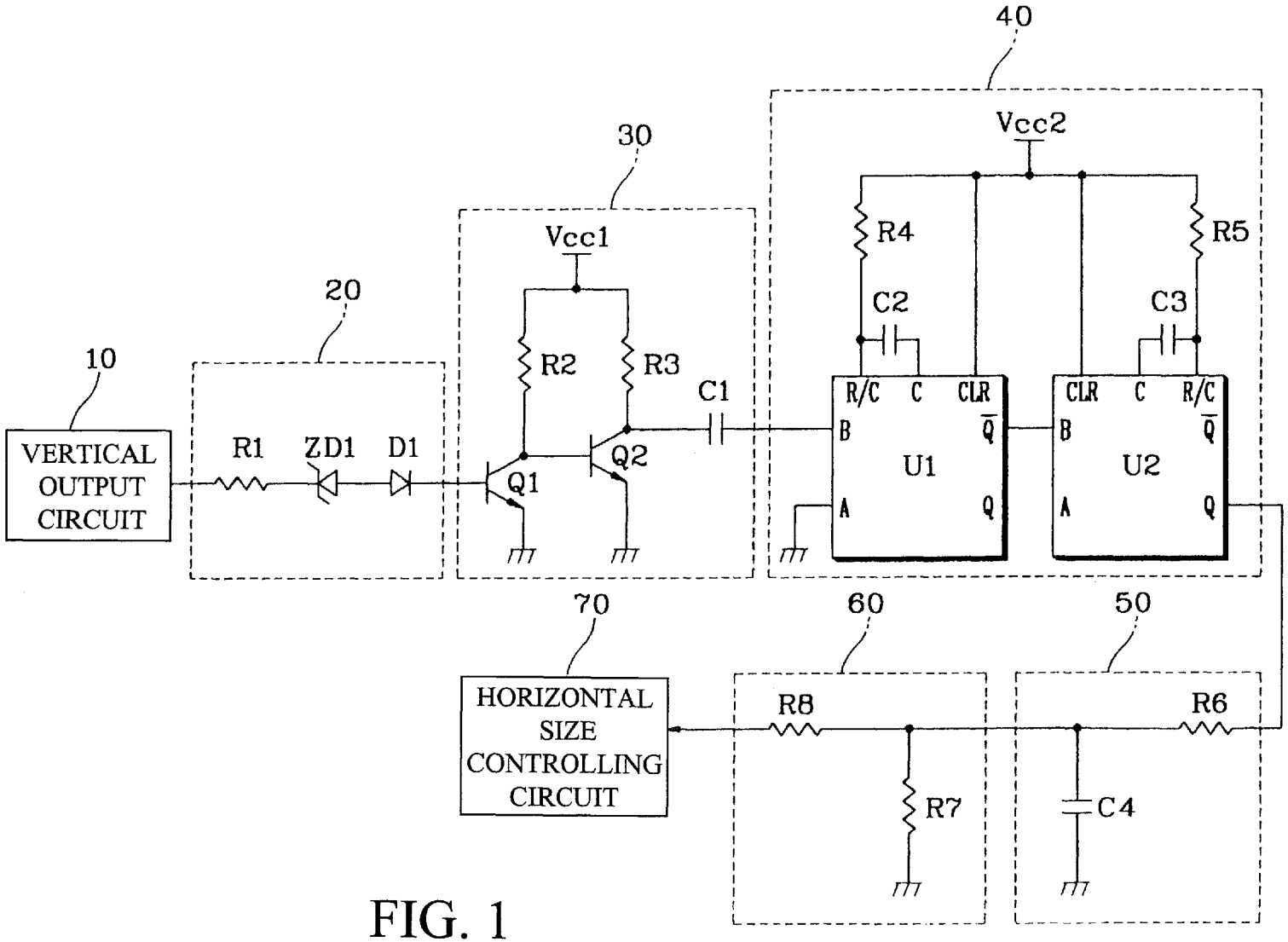
FIG. 1 is a schematic diagram illustrating a display device having a circuit which corrects a distortion of a bottom portion of a monitor according to an embodiment of the present invention.

The present invention will be apparent from the following detailed description in conjunction with the accompanying drawing, wherein like reference symbols represent the same or similar components:

FIG. 1 is a schematic diagram illustrating a display device having a circuit which corrects a distortion of a bottom portion of a monitor according to an embodiment of the present invention. The display device includes a vertical signal detecting part 20 which receives a vertical output signal from a vertical output circuit 10, a vertical blanking signal generating part 30 which converts the detected vertical output signal from the vertical signal detecting part 20 to a vertical blanking signal, a phase controlling part 40 which receives the vertical blanking signal from the vertical blanking signal generating part 30 and varies a phase of the vertical blanking signal, an integral circuit 50 which integrates the phase varied vertical blanking signal output from the phase controlling part 40 and piling up on a horizontal size controlling circuit 70, through a voltage distributing part 60 which distributes the integrated signal output from the integral circuit 50.

The vertical signal detecting part 20 includes a resistor R1 which provides a resistance, a zener diode ZD1 which turns on/off according to a size of the vertical output signal passed through the resistor R1, and a diode D1.

The vertical blanking signal generating part 30 includes of a first transistor Q1 operating by receiving the detected vertical output signal from the vertical signal detecting part 20 at a base terminal of the first transistor Q1, a second transistor Q2 operating by receiving a voltage outputted to a collector terminal of the first transistor Q1 in a base terminal of the second transistor Q2, and second and third resistors R2, R3 connected at first ends to the collector terminals of the transistors Q1, Q2, respectively, and connected to a predetermined voltage Vcc1 at second ends thereof, and a coupling capacitor C1 connected to the collector of the second transistor Q2 and the first end of the third resistor R3.

The phase controlling part 40 includes two mono-stable multi-vibrators U1, U2. The first monostable multi-vibrator U1 reverses a phase of the vertical blanking signal outputted from the vertical blanking signal generating part 30. The vertical blanking signal is applied to an input terminal B of the first monostable multi-vibrator U1, the input terminal B being connected to the coupling capacitor C1 of the vertical blanking signal generating part 30. A predetermined voltage Vcc2 is applied to a reset clear terminal R/C, a capacitor C2 has a first end connected to the reset clear terminal R/C and a second end connected to a clock terminal C, and a resistor R4 conveying a predetermined voltage Vcc2 is connected to a connecting point (node) of the reset clear terminal R/C with the second end of the capacitor C2. The predetermined voltage Vcc2 is applied to the clear terminal CLR of the first monostable multi-vibrator U1.

The vertical blanking signal, which is conveyed through a reverse output terminal Q of the monostable multi-vibrator U2 and has a reverse phase, is applied to an input terminal B of the second monostable multi-vibrator U2. The predetermined voltage Vcc2 is applied to the clear terminal CLR of the second monostable multi-vibrator U2, a capacitor C3 has a first end connected to a clock terminal C and a second end connected to a reset clear terminal R/C, and a resistor R5 conveying the predetermined voltage Vcc2 is connected to a connecting point (mode) of the reset clear terminal R/C with the second end of the capacitor C3. The phase varied vertical blanking signal provided from the output terminal Q of the second monostable multi-vibrator U2 is conveyed to a horizontal size controlling circuit 70 through the integral circuit 50 (resistor R6 and capacitor C4) and the voltage distributing part 60 (resistors R7 and R8).

The vertical signal detecting part 20 makes the vertical output signal (pulse) generated in the vertical output circuit 10 take on a necessary voltage at the resistor R1 and the zener diode ZD1 and applies it through the diode D1 to the base of the first transistor Q1 of the vertical blanking signal generating part 30. The signal outputted through the collector terminal of the first transistor Q1 is applied to the base of the second transistor Q2. The signal outputted to the collector terminal of the second transistor Q2 is applied to the input terminal B of the first monostable multi-vibrator U1 through the coupling capacitor C1 of the first monostable multi-vibrator U1.

The first monostable multi-vibrator U1 reverses the phase of the vertical blanking signal output form the vertical blanking signal generating part 30, so that the phase reversed vertical blanking signal is processed by a time characteristic constant of a resistor R5 and a capacitor C3 connected to the second monostable multi-vibrator U2 so as to be formed at a last time of a vertical frequency. The phase varied vertical blanking signal output from the phase controlling part 40 is applied to the integral circuit 50 which includes the resistor R6 and the capacitor C4. The integrated signal is distributed by the resistors R7 and R8 which form the voltage distributing part 60 and is applied to the horizontal size controlling circuit 70. Therefore, a distortion generated at a vertical bottom portion of a picture display on a monitor can be corrected.

As described above, the effect of the present invention lies in that the distortion generated at the vertical bottom portion of the picture according to the feature of the deflection yoke of the display device can be corrected.

It will be apparent to those skilled in the art that various modifications can be made in the present invention, without departing from the spirit of the invention. Thus, it is intended that the present invention cover such modifications as well as variations thereof, within the scope of the appended claims and their equivalents.

What is claimed is:

1. A display device for correcting a distortion of a bottom portion of a monitor and having a vertical output circuit which generates a vertical output signal and a horizontal size controlling circuit, the display device comprising:

a vertical signal detecting part which detects the vertical output signal from the vertical output circuit;

a vertical blanking signal generating part which converts the vertical output signal to a vertical blanking signal;

a phase controlling part which varies a phase of the vertical blanking signal; and an integral circuit which integrates the phase varied vertical blanking signal and transmits the integrated signal to the horizontal size controlling circuit which receives the integrated signal.

2. The display device as claimed in claim 1, wherein said phase controlling part comprises:

a phase reversing part which reverses a phase of the vertical blanking signal; and a phase forming part which controls the phase reversed vertical blanking signal to be formed at a last pulse of a vertical frequency.

3. The display device as claimed in claim 2, wherein:

said phase reversing part comprises a first monostable multi-vibrator which includes a first input terminal to receive the vertical blanking signal;

a first reset clear terminal;

a first clock terminal;

a first clear terminal; and a reverse output terminal to output the phase reversed vertical blanking signal;

a first capacitor having a first end connected at a first node to said first reset clear terminal and a second end connected to said first clear terminal, and a first resistor having a first end connected to the first node and a second end connected to a predetermined voltage; and said phase forming part comprises a second monostable multi-vibrator which includes a second input terminal to receive the reversed phase vertical blanking signal;

a second reset clear terminal;

a second clock terminal;

a second clear terminal; and an output terminal to output the phase varied vertical blanking signal;

a second capacitor having a first end connected at a second node to said second reset clear terminal and a second end connected to said second clear terminal, and a second resistor having a first end connected to the second node and a second end connected to the predetermined voltage;

wherein said first and second clear terminals are connected to the predetermined voltage.

4. The display device as claimed in claim 1, further comprising:

a voltage distributing part formed between said integral circuit and the horizontal size circuit, to distribute an output voltage of the integrated circuit to the horizontal size controlling circuit.

5. The display device as claimed in claim 4, wherein said voltage distributing part comprises:

a first resistor having a first end connected at a node to said integral circuit to receive the integrated signal; and a second resistor having a first end connected to the node and a second end connected said horizontal size controlling circuit.

6. The display device as claimed in claim 1, wherein said phase controlling part comprises a monostable multi-vibrator.

7. The display device as claimed in claim 1, wherein said vertical blanking signal generating part comprises:

a first transistor having a base to receive the detected vertical output signal and a collector connected at a first node;

a resistor having a first end connected to the first node and a second end connected to a predetermined voltage;

a second transistor having a base connected to said first node and a collector connected at a second node to output the vertical blanking signal; and a second resistor having a first end connected to said second node and a second end connected to the predetermined voltage.

8. The display device as claimed in claim 1, wherein said vertical signal detecting part comprises:

a resistor having a first end connected to the vertical output circuit and a second end;

a zener diode having a first end connected to the second end of said resistor and a second end; and a diode having a first end connected to the second end of said zener diode and a second end connected to said vertical blanking signal generating part and which outputs the vertical blanking signal.

9. The display device as claimed in claim 1, wherein said vertical signal detecting part ensures that the vertical output signal has a minimum voltage.

10. A display device for correcting a distortion of a bottom portion of a monitor by controlling a vertical blanking signal and having a horizontal size controlling circuit, the display device comprising:

a phase controlling part to vary a phase of the vertical blanking signal; and an integral circuit to integrate the phase varied vertical blanking signal, and to transmit the integrated signal to the horizontal size controlling circuit.

11. The display device as claimed in claim 10, further comprising:

a voltage distributing part formed between said integral circuit and said horizontal size circuit, to distribute an output voltage of the integrated circuit to the horizontal size controlling circuit.

12. The display device as claimed in claim 11, wherein said voltage distributing part comprises:

a first resistor having a first end connected at a node to said integral circuit to receive the integrated signal; and a second resistor having a first end connected to the node and a second end connected said horizontal size controlling circuit.

13. The display device as claimed in claim 10, wherein said phase controlling part comprises a monostable multi-vibrator.

14. The display device as claimed in claim 10, wherein said phase controlling part comprises:

a phase reversing part which reverses a phase of the vertical blanking signal; and a phase forming part which controls the reversed vertical blanking signal to be formed at a last pulse of a vertical frequency.

15. The display device as claimed in claim 14, wherein:

said phase reversing part comprises a first monostable multi-vibrator which includes a first input terminal to receive the vertical blanking signal;

a first reset clear terminal;

a first clock terminal;

a first clear terminal; and a reverse output terminal to output the phase reversed vertical blanking signal;

a first capacitor having a first end connected at a first node to said first reset clear terminal and a second end connected to said first clear terminal, and a first resistor having a first end connected to the first node and a second end connected to a predetermined voltage; and said phase forming part comprises a second monostable multi-vibrator which includes a second input terminal to receive the reversed phase vertical blanking signal;

a second reset clear terminal;

a second clock terminal;

a second clear terminal; and an output terminal to output the phase varied vertical blanking signal;

a second capacitor having a first end connected at a second node to said second reset clear terminal and a second end connected to said second clear terminal, and a second resistor having a first end connected to the second node and a second end connected to the predetermined voltage;

wherein said first and second clear terminals are connected to the predetermined voltage.

* * * * *